US005733112A

United States Patent [19]

Kang

[11] Patent Number: 5,733,112

[45] Date of Patent: Mar. 31, 1998

[54] ROTARY COMPRESSOR HAVING A ROLLER MOUNTED ECCENTRICALLY IN A CYLINDRICAL CHAMBER OF A ROTATABLE CYLINDER

[75] Inventor: Heui-Jong Kang, Seoul, Rep. of Korea

[73] Assignee: Samsung Electronics Co., Ltd., Suwon, Rep. of Korea

[21] Appl. No.: 635,469

[22] Filed: Apr. 22, 1996

Related U.S. Application Data

[63] Continuation-in-part of Ser. No. 352,854, Dec. 2, 1994, abandoned.

[30] Foreign Application Priority Data

Dec. 8, 1993 [KR] Rep. of Korea ..... 93-26915
Jun. 27, 1994 [KR] Rep. of Korea ..... 94-14899

[51] Int. Cl.[6] ..... F03C 2/00

[52] U.S. Cl. ..... 418/174; 418/177

[58] Field of Search ..... 418/164, 172, 418/174, 177

[56] References Cited

U.S. PATENT DOCUMENTS

| | | | |
|---|---|---|---|
| 333,994 | 1/1886 | Chichester | 418/174 |
| 2,122,462 | 7/1938 | Fricke | 418/174 |
| 2,670,894 | 10/1954 | Warrick et al. | 418/174 |
| 4,477,231 | 10/1984 | Swift | 418/177 |

*Primary Examiner*—Charles G. Freay
*Attorney, Agent, or Firm*—Burns, Doane, Swecker & Mathis, L.L.P.

[57] ABSTRACT

A rotary compressor has a motor-driven rotary body forming a cylindrical chamber in which a roller is rotatable about an axis eccentrically related to the axis of the chamber. The roller is of less diameter than the chamber so that the roller and chamber walls form a space. Vanes are slidably mounted in the body and are spring biased radially against the roller to divide the space into pockets. The volume of each pocket expands and contracts as the body is rotated. A gas inlet and a gas outlet are disposed at an axial end of the chamber. Each pocket communicates with the inlet to draw-in gas during the volume expansion. The drawn-in gas is pressurized during an initial phase of the volume contraction and then discharged through the gas outlet during a subsequent phase of the volume contraction.

12 Claims, 6 Drawing Sheets

ROTARY COMPRESSOR HAVING A ROLLER MOUNTED ECCENTRICALLY IN A CYLINDRICAL CHAMBER OF A ROTATABLE CYLINDER

RELATED INVENTION

This is a Continuation-in-Part of Ser. No. 08/352,854, filed Dec. 2, 1994 and now abandoned.

BACKGROUND OF THE INVENTION

1. Field of the Invention

The present invention relates to a rotary compressor in which a roller is disposed eccentrically within a cylindrical chamber of a body to define a space which is alternately expanded and contracted in volume during relative rotation between the body and roller.

2. Description of the Prior Art

As a representative conventional rotary compressor, Japanese Laid-Open Patent Application No. Sho 63(1988)-55388 entitled, "Rotary type compressor" has been disclosed.

FIG. 6 is a sectional view for illustrating an operational principle of the conventional rotary compressor.

According to FIG. 6, a cylinder 3 is provided at one side thereof with an opening 52, in which a vane 5 is mounted.

The vane 5 is so disposed as to freely move back and forth in the opening 52, and receives a forwarding force biasing the vane into an inner side of the cylinder 3 by way of a spring 4.

Furthermore, a suction inlet 7 is formed in the cylinder adjacent one side of the vane for introducing refrigerant gas into the cylinder, and a discharge outlet 8 for discharging compressed refrigerant gas to the outside disposed at the other side thereof.

The discharge outlet 8 is provided at an external side thereof with a discharge valve 9, which closes the discharge outlet 8 and opens the outlet 9 when a predetermined force of internal pressure is established.

Meanwhile, a shaft 1 for being rotated by power from a motor (not shown) is connected to an eccentric shaft 2, and an external side of shaft carries a roller 6.

The roller 6 is disposed within the cylinder 3 and is rotated along an inner side of the cylinder 3 by rotational drive of the eccentric shaft 2.

At this time, the vane 5 goes forward into the cylinder 3 by way of the elasticity of the spring 4 to thereby contact a peripheral surface of the roller 6 at all times, so that an inner space of the cylinder 3 is partitioned into two separate areas.

In other words, the inner space of the cylinder 3 is partitioned into a suction portion 3*a* and a compression portion 36.

In FIG. 6, reference numeral "0" is a center of the shaft 1 and "P" is a center of the eccentric shaft 2, wherein the eccentric shaft 2 is eccentrically separated at a predetermined distance L from the center of the shaft 1.

Accordingly, when the shaft 1 is rotated, the roller 6 performs a rotational drive within the cylinder 7 by way of the rotational drive of the eccentric shaft 2.

The refrigerant gas is absorbed into the suction portion 3*a* of the cylinder 3 through the suction inlet 7 according to rotation of the roller 6, and the refrigerant gas which has already been absorbed is compressed at high pressure by the compression portion 3*b*.

At this time, because the discharge outlet 8 is provided at an external side thereof with the flat-bodied discharge valve 9 of a predetermined elasticity, when the compression portion 3*b* attains a predetermined pressure, the discharge outlet is opened to thereby cause the refrigerant gas to be discharged to the external side of the cylinder 3 through the discharge outlet 8.

Then, the roller 6 is rotated, and when it passes the discharge outlet 8, no pressure is applied to the discharge valve 9 to thereby cause the discharge outlet 8 to be closed and to stop the discharge of the refrigerant.

However, in the construction thus described, the roller is accorded with an unbalanced force by the pressure difference between the suction portion 3*a* and the compression portion 3*b*, thereby resulting in vibration.

Furthermore, there is another problem in that the opening and/or closing of the discharge valve 9 has generated noise and at the same time, efficiency has been reduced because of the discharge valve 9 acting as a moving resistor, and reliability has been reduced by the possibility of the valve being damaged.

Meanwhile, Japanese Laid-Open Patent Application No. Sho 63(1988)-208688 entitled, "Rotary Compressor" disclosed that the vibration of the roller caused by the pressure difference can be considerably reduced by way of formation of a plurality of vanes, suction inlets and compression outlets.

FIG. 7 is a sectional view for illustrating principles of the rotary compressor thus described.

According to FIG. 7, the rotational vibration of the compressor has been reduced by forming a plurality of suction portions and compression portions by way of a plurality of vanes 5*a* and 5*b*.

Of course, the plurality of vanes 5*a* and 5*b* are disposed in a plurality of recesses 52*a* and 52*b* formed in the cylinder 3, and are biased against the cylinder 3 by a plurality of springs, thereby contacting the roller 3 at all times.

Furthermore, a plurality of suction inlets 7*a* and 7*b* and a plurality of discharge outlets 8*a* and 8*b* are disposed in the cylinder.

Throughout the drawings, because like reference numerals and symbols as in FIG. 6 perform the same functions, detailed descriptions thereabout are omitted for simplicity of illustration and explanation.

However, these kinds of constructions thus described cannot solve the unbalanced force of the roller completely, still generating the vibration.

Furthermore, there still remains a problem in that the noise is generated by the valve 9. The efficiency of the compressor is reduced by the valve as the valve acts as a moving resistor and the reliability thereof is lowered due to damage of the valve.

SUMMARY OF THE INVENTION

Accordingly, the present invention has been disclosed to solve the aforementioned problems, and it is an object of the present invention to eliminate the vibration of the roller caused by the pressure difference of the refrigerant gas.

Furthermore, it is another object of the present invention to eliminate the valve for reduction of the noise, to increase the efficiency of the compressor and to improve the reliability of the same as well.

In accordance with the objects of the present invention, there is provided a rotary compressor, the compressor comprising: a cylindrical cylinder with one side thereof being closed by a fixing unit; a vane movably disposed in an opening of the fixing unit, the latter provided with a suction inlet, discharge outlet and an eccentric shaft and tightly closing an upper surface of the cylinder; and a roller for being disposed on an eccentric shaft of the fixing unit and for partitioning an inner area of the cylinder into a packet by way of contact with the vane, and for causing a predetermined gas to flow into the space of the cylinder according to rotation of the cylinder and at the same time for compressing the infused gas to thereby discharge the same to the outside.

BRIEF DESCRIPTION OF THE DRAWINGS

For a better understanding of the nature and objects of the invention, reference should be made to the following detailed description taken in conjunction with the accompanying drawings in which:

FIG. 3A is a plan view and FIG. 3B is a side view thereof:

DETAILED DESCRIPTION OF PREFERRED EMBODIMENTS OF THE INVENTION

Hereinafter, a preferred embodiment of the invention will be described by way of example and with reference to the accompanying drawings.

Figure 1:
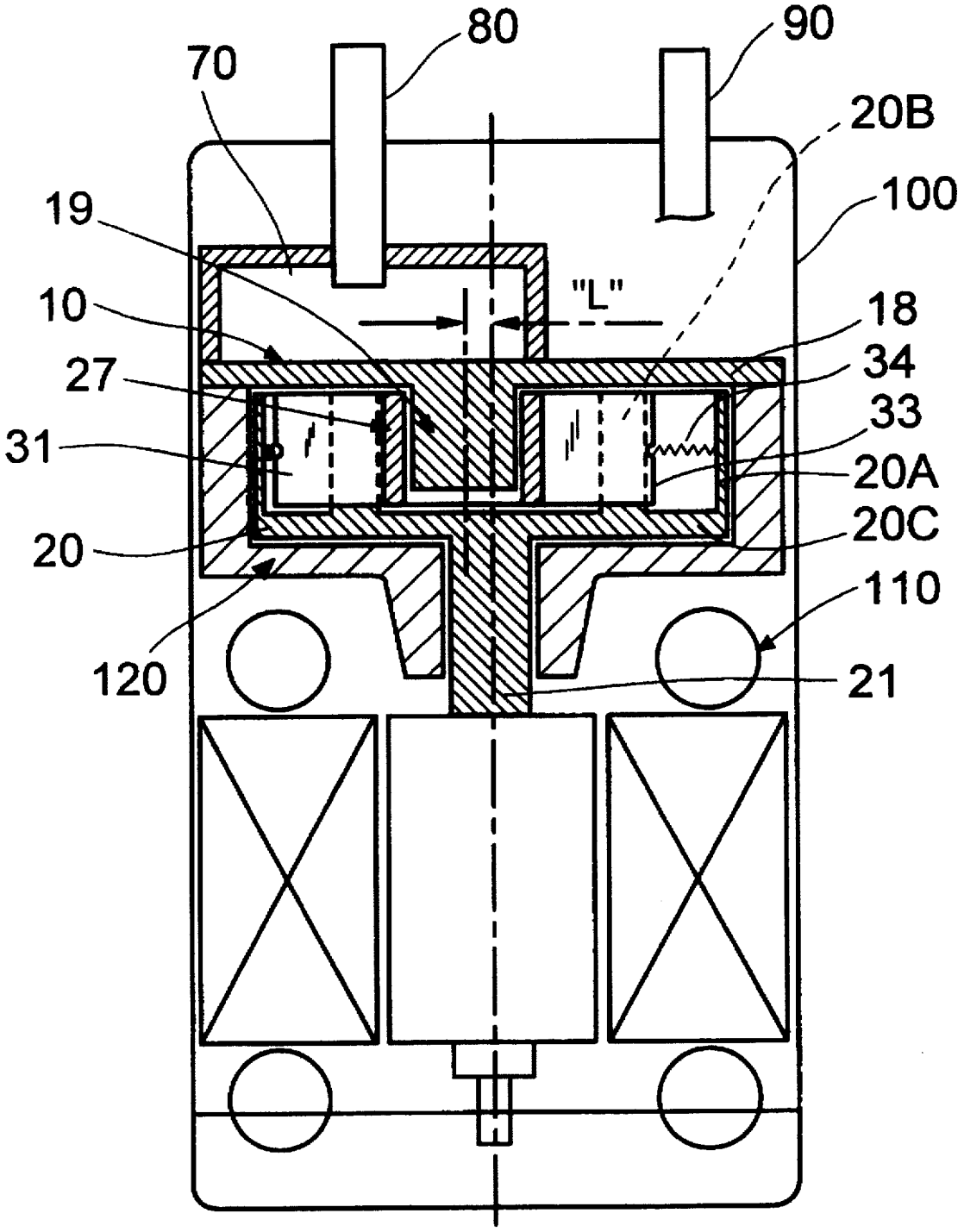
FIG. 1 is a longitudinal sectional view through a rotary compressor according to the present invention.

According to FIG. 1, a case 100 of the compressor houses a motor 110, a cylinder 20 and a fixing unit 10.

The motor 110 is a driving means for rotating the cylinder 20.

The motor has a shaft 21 thereof connected with the cylinder 20 by way of a fastening means (not shown).

The cylinder 20 includes outer and inner walls 20A, 20B spaced radially apart and projecting upwardly from a base 20C. The outer wall 20A has a round cylindrical shape with one side thereof being closed and is formed with an internal chamber 25 divided into more than one opening portion or pocket defined by movable vanes 31 and 32. The pockets are formed at each side thereof with discharge holes (to be explained later).

The vanes 31 and 33 are biased radially inwardly toward an interior chamber 25 of the inner wall 20B by coil springs 32, 34. Each spring 32, 34 bears against a respective vane and a radially inwardly facing surface of the outer cylindrical wall 20A.

Figure 2A:
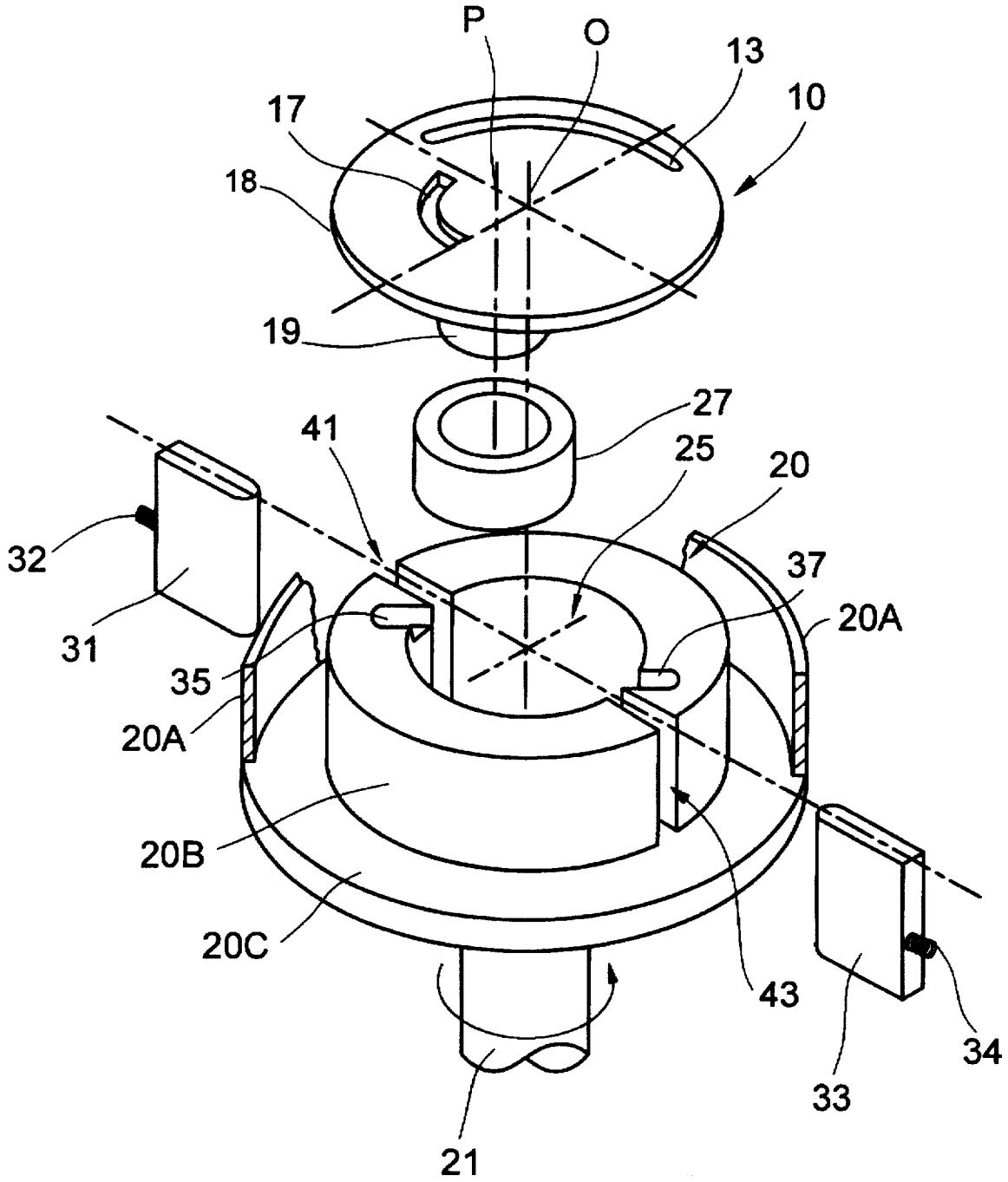
FIG. 2A is an exploded perspective view of the rotary compressor according to the present invention.
Figure 2B:
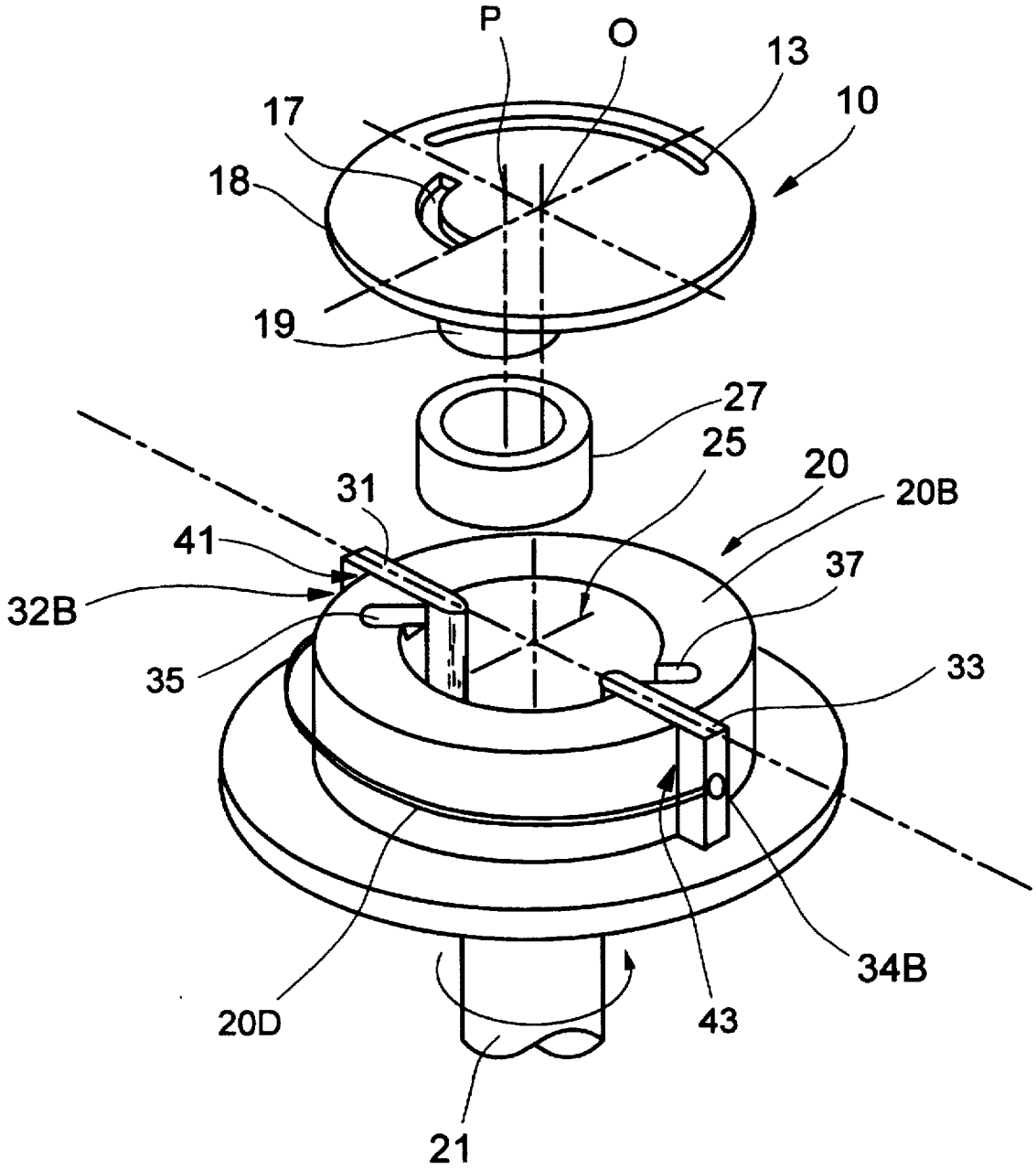
FIG. 2B is a view similar to FIG. 2A depicting an alternative embodiment of the invention.

An alternative spring arrangement depicted in FIG. 2B is in the form of an elastic C-shaped snap ring 20D, the ends of which are connected to portions 32B, 34B of the vanes. Hence, the spring 20D only contacts the vanes, and rotates along with the cylinder 20 and the vanes.

The cylinder 20 is disposed beneath the fixing unit 10 which is fixed to the case 100. A lubricant is situated in the interface between an upper end of the cylinder 20 and a bottom surface of the fixing member to prevent frictional wear and create a seal preventing the escape of gas from the chamber 25. Thus, a lubricating oil could be supplied to the interface. Alternatively, a conventional sealed bearing structure could be provided.

The fixing unit 10 is in close contact with the cylinder 20 so that the chamber 25 is as tightly closed as possible whereas the cylinder 20 is so mounted as to be rotatable beneath the fixing unit.

The fixing unit 10 comprises: a plate member 18 formed with a suction inlet 17 and a discharge outlet 13 (to be explained later); and an integral eccentric shaft 19 of a cylindrical shape at the bottom of the plate member 18.

The center of the eccentric shaft 19 is eccentrically disposed at a predetermined distance L from a rotational center of the cylinder 20.

Furthermore, the cylinder 20 is provided at the outside thereof with a bearing 120 for smooth rotation of the cylinder 20.

The bearing 120 has a cylindrical shape, so that a rotational shaft of the cylinder 20 can pass through the bearing at the bottom area thereof.

Meanwhile, a suction pipe 80 and a discharge pipe 90 which project through the case 100 of the compressor are connected respectively to a suction chamber 70 and a discharge chamber (not shown) disposed within an inner side of the compressor, and the suction chamber 70 and the discharge chamber are in turn connected respectively to the suction inlet 17 and discharge outlet 13 (to be explained later) formed in the plate member 18 of the fixing unit 10.

According to FIG. 2A, the chamber 25 is concentric with the rotational shaft 21.

The cylinder 20 has a shape where one side thereof is connected to the rotational shaft 21 so that the corresponding side of chamber 25 is tightly closed.

Furthermore, the inner wall 20B of the cylinder 20 is formed with slots 41 and 43 at diametrically opposite positions, wherein respective vanes 31 and 33 are in the slots 41 and 43.

The vanes 31 and 33 are so disposed as to be freely movable in the slots 41 and 43 and are biased into the chamber 25 by the elasticity of the springs 32 and 34 (or 20D).

Formed in the wall 20B adjacent respective slots 41 and 43 are discharge holes 35 and 37, so that the refrigerant which has flowed into and has been compressed in the chamber 25 can be discharged.

The discharge holes 35 and 37 are so formed that the discharge speed of the refrigerant in the chamber 25 can be slow (by way of example, slower than 0.2 Mach) and remnant refrigerant can be minimized in volume.

In other words, the discharge holes 35 and 37 are best formed with cylindrical shapes of large radius and lower heights.

The plate member 18 is formed with a discharge outlet 13 and a suction inlet 17 having a predetermined length and width.

The discharge outlet 13 has arc-shaped sides 13A, 13B each formed with a predetermined radius from the center "0" of the plate member 18, and the suction inlet 17 has arc-shaped sides 17A, 17B each formed with a predetermined radius from the center "P" of the eccentric shaft 19.

The eccentric shaft 19 is inserted into a cylindrical roller 27.

An outer diameter of the eccentric shaft 19 is formed to be a little smaller than an inner diameter of the roller 27. The roller 27 is disposed within the chamber 25 of the cylinder 20 and an outer surface of the roller 27 tightly engages an inner surface of the wall 20B.

Meanwhile, the discharge outlet 13 and the suction inlet 17 are designed on the following principle.

First of all, in FIGS. 1 and 2A, the chamber 25 of the cylinder 20 is divided into a discharge side and suction side by the roller 27 and vanes 31 and 33, which can be formulated in the following way:

$$P1V1^n = P2V2^n$$

$$V2 = V1\left(\frac{P1}{P2}\right)^{1/n}$$

(where V1=cylinder volume at initial compression, V2=cylinder volume before discharge, P1=suction pressure, P2=discharge pressure, and n=polytropic index.)

Figure 3A:
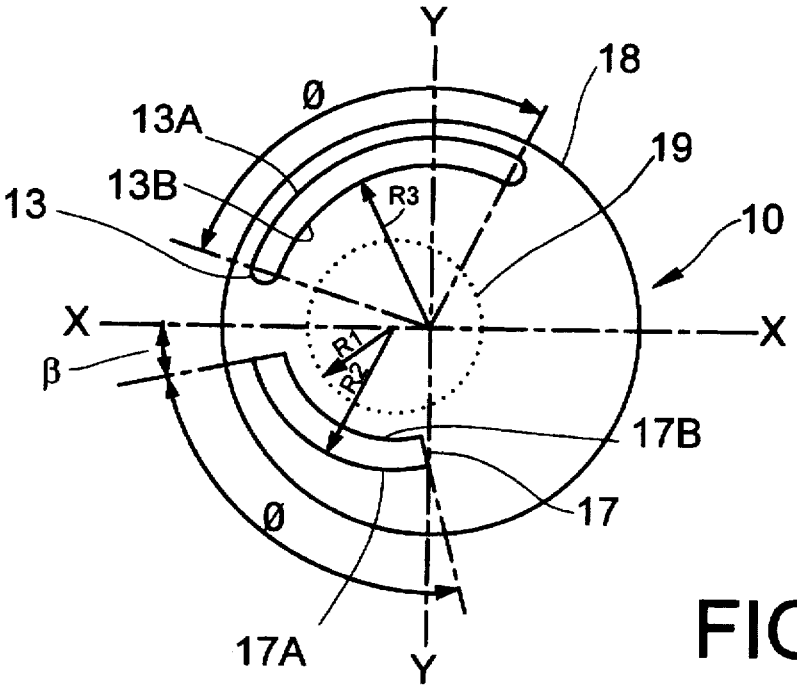
FIGS. 3A and 3B are schematic views illustrating the structure of a fixing unit shown in FIGS. 1, 2A and 2B, whereby
Figure 3B:
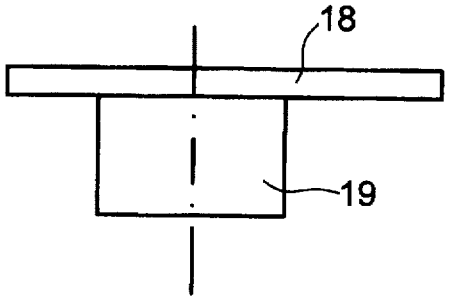

Based on established pressures P1 and P2, and cylinder volume V1 prior to compression, an angle θ corresponding to the cylinder volume V2 during the discharge is determined to thereby form the discharge outlet 13 (see FIG. 3A).

The suction inlet 17 is formed with an angle θ within a domain which has nothing to do with the compression process in order to facilitate a smooth suction of the refrigerant.

In FIG. 3A, angle β is maintained which is as wide as the discharge outlet 35 or 37, so that refrigerant cannot leak from compression space through the discharge hole 35 or 37.

Figure 4:
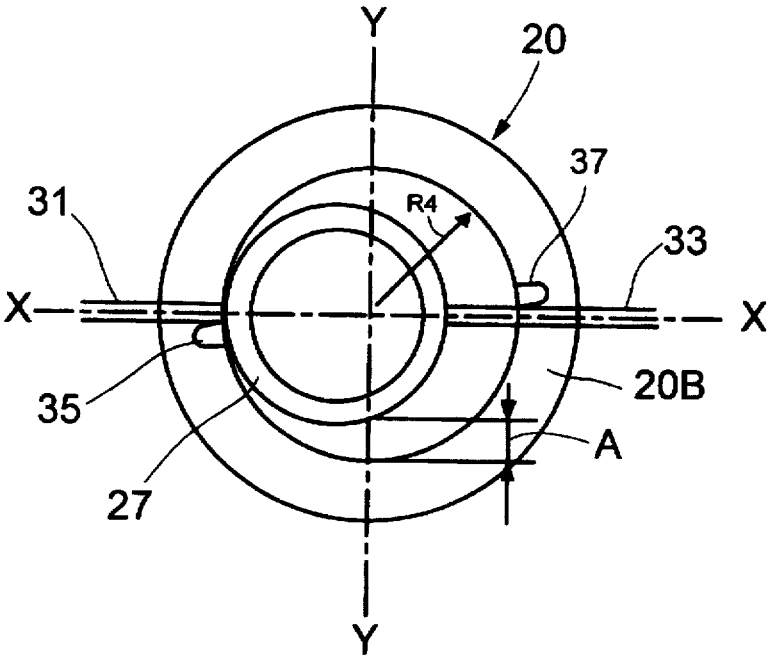
FIG. 4 is a plan view for illustrating a state where the roller is disposed within the cylinder shown in FIGS. 1, 2A and 2B.

Meanwhile, in FIGS. 3A and 4, the roller 27 has an outer radius R1, and another radius R2 is a sum(R2=R1+A) of the radius R1 of the roller 27 and a difference A (see FIG. 4) between R1 and the inner diameter of the wall 20B on a Y—Y axis when the center of the roller 27 is situated on the X—X axis.

Furthermore, a distance from the center "0" of the plate member 18 to an inner side 13B of the discharge outlet 13 (i.e., the radius R3 of the arc-shaped inner side the discharge outlet 13) should be larger than the radius R4 of the chamber 25 in the cylinder 20.

Figure 5A:
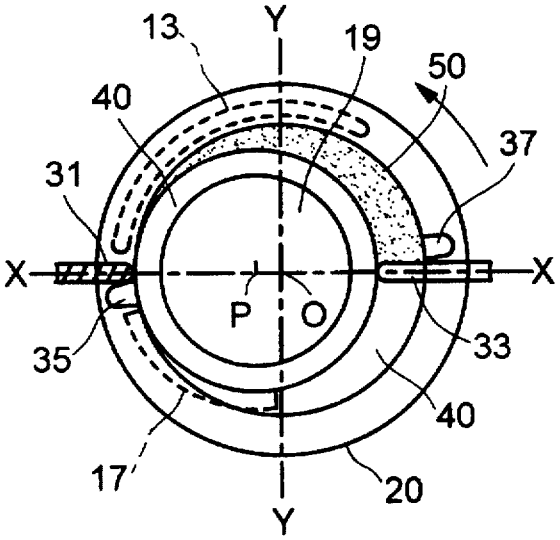
FIGS. 5A, 5B, 5C and 5D depict respective phases of operation of the rotary compressor according to the present invention.
Figure 5B:
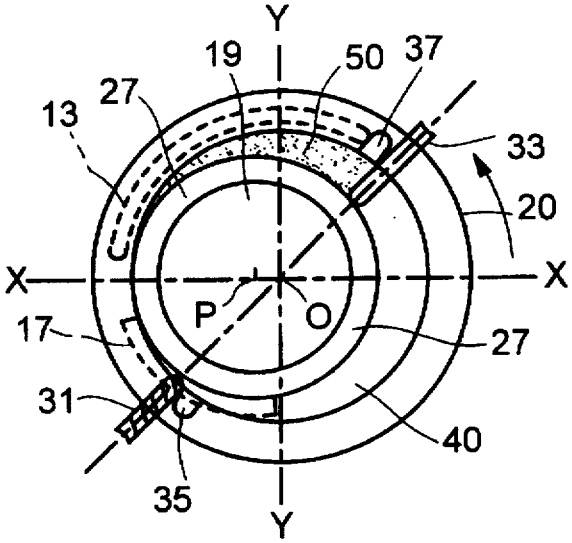

The discharge holes 35 and 37 extend from an inner side of the wall 20B to an external arc side 13A of the discharge outlet 13 as shown in FIG. 5B.

FIGS. 5A through 5D are operating diagrams of the rotary compressor according to the present invention, where the fixing unit 10 is not shown, and in order to help better understand the structure, the discharge outlet 13 and the suction inlet 17 are illustrated in dotted lines.

First of all, FIG. 5A illustrates a schematic diagram where the vanes 31 and 33 are situated at a 0 degree position i.e., are situated along the horizontal axis (X—X) passing through a rotational center 0 of the cylinder 20. The cylinder 20 is rotated counter clockwise.

At this time, the chamber of the cylinder 20 is partitioned into two pockets, 40, 50 by the vanes 31 and 33 and the roller 27.

In other words, when the cylinder is rotated the refrigerant is sucked into one of the pockets 40 while previously absorbed refrigerant is compressed in the other pocket 50.

Accordingly, when the cylinder keeps rotating beginning at the FIG. 5A position, the refrigerant is infused into the space 40 through suction pipe 80 because the space 40 is interconnected with the suction inlet 17.

Furthermore, because the space 50 is tightly closed, the refrigerant already in the space 50 becomes compressed.

The aforementioned processes keep going until the cylinder 20 reaches a position illustrated in FIG. 5B.

FIG. 5B illustrates a state just before the refrigerant compressed in the space 50 is to be discharged, and the refrigerant keeps being infused into the space 40 through the suction inlet 17, while the refrigerant of the space 50 keeps being compressed.

When the cylinder 20 keeps rotating past the position illustrated in FIG. 5B, the refrigerant compressed in the space 50 is discharged to the discharge outlet 13 through the discharge hole 37.

Figure 5C:
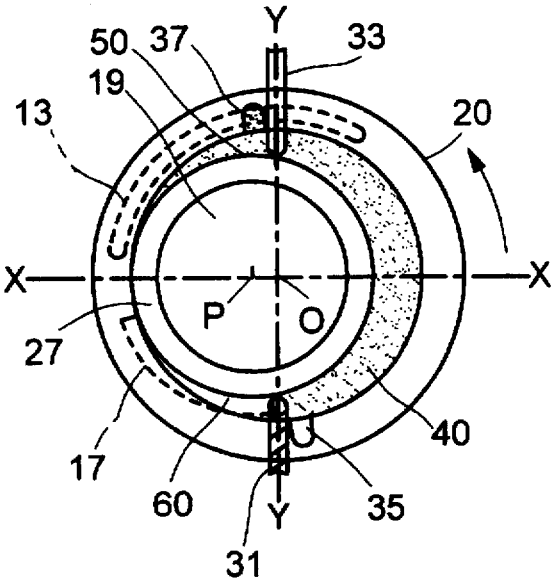

FIG. 5C is a schematic diagram for illustrating a state where the vanes 31 and 33 are situated at 90 degrees relative to the horizontal axis (X—X).

At this location, the space 40 is closed, and a new space 60 is formed under the horizontal axis (X—X) and at a left side of vertical axis (Y—Y).

Of course, the refrigerant keeps being compressed in the space 50, thereby being discharged.

Subsequent to the processes shown in FIG. 5C, the refrigerant infused into the space 40 becomes compressed, and the refrigerant in the space 50 keeps being compressed to thereby be discharged while the refrigerant is infused into the space 60 through the suction inlet 17.

Figure 5D:
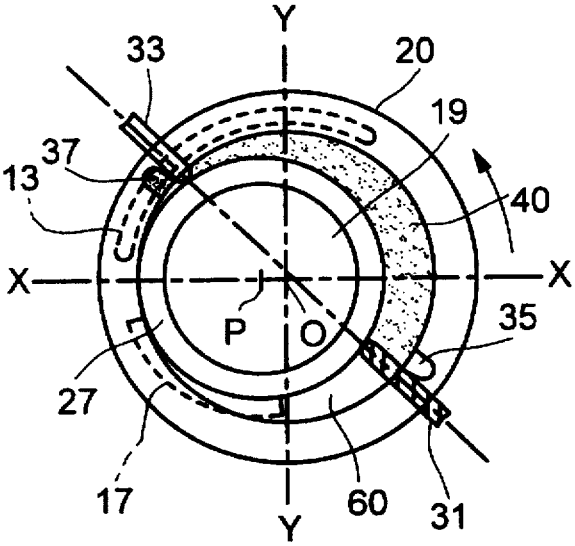
Figure 6:
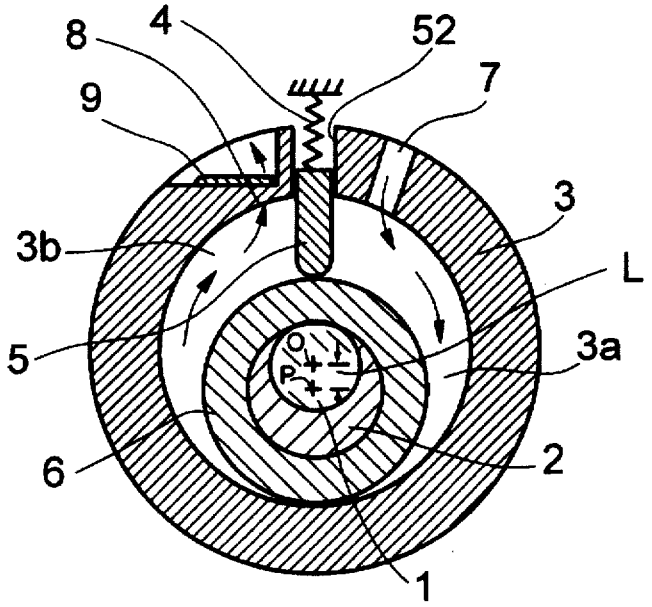
FIG. 6 (PRIOR ART)
FIGS. 6 and 7 are sectional views for illustrating respective conventional rotary compressors.
Figure 7:
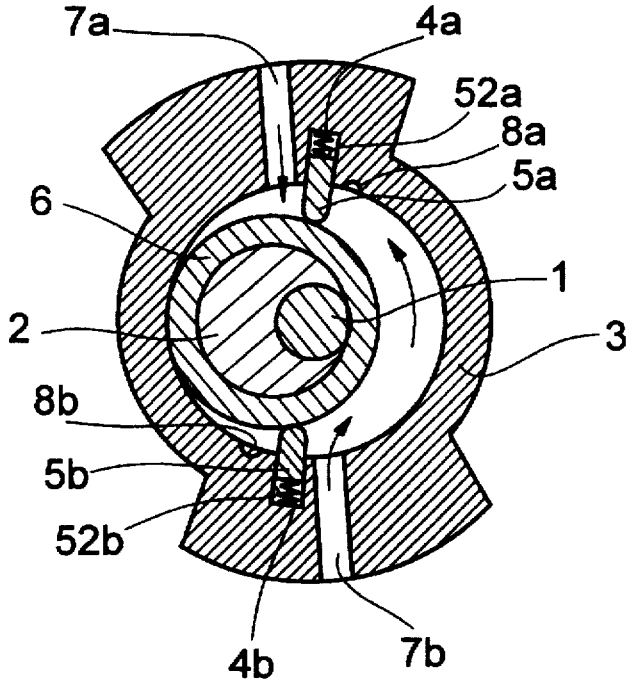
FIG. 7 (PRIOR ART)

FIG. 5D is a schematic diagram for illustrating a state where the vanes 31 and 33 are situated at 135 degrees relative to the horizontal axis (X—X). At this time, the space 40 is tightly closed and the refrigerant already in that space is gradually being compressed.

The refrigerant remaining in the space 50 keeps being compressed to thereafter be discharged through the discharge hole 37 and the discharge outlet 13.

The refrigerant keeps being infused into the space 60 through the suction inlet 17.

Then, the cylinder 20 keeps being rotated to thereby be positioned in a state as illustrated in FIG. 5A.

As seen from the foregoing, the compressor according to the present invention keeps repeating the aforementioned processes, thereby sucking in the refrigerant, compressing the absorbed refrigerant and discharging the compressed refrigerant.

Accordingly, the rotary compressor according to the present invention reduces the vibration because a large-mass cylinder (instead of roller 27) is rotated to thereby increase a rotational inertia.

Furthermore, the present invention has an advantage in that the rotary compressor eliminates the valve at the discharge outlet to thereby reduce the noise and at the same time, rules out flow loss of the compressed refrigerant resultant from resistance of the valve to thereby increase efficiency of the compressor, and prevents reliability of the compressor from being degraded since there is no risk of valve damage.

The foregoing description and drawings are illustrative and are not to be taken as limiting.

Still other variations and modifications are possible without departing from the spirit and scope of the present invention.

Specifically, the above mentioned embodiment employs two vanes. However, it should be apparent that the number of the vanes is not critical to the present invention.

In other words, the present invention can employ more than two vanes, but the lengths of the suction inlet and discharge outlet should be varied according to the number of the vanes.

What is claimed is:

1. A rotary compressor, comprising:

a rotary body having a cylindrical surface and axially spaced ends forming a cylindrical chamber, said body being rotatable about a stationary first axis coinciding with a longitudinal axis of said chamber;

a cylindrical roller mounted in said chamber and rotatable about a stationary second axis arranged parallel and eccentrically relative to said first axis, an outer diameter of said roller being smaller than a diameter of said surface so that a space is formed between said roller and said surface;

a stationary gas discharge outlet disposed adjacent one of said axially spaced ends;

a stationary gas inlet opening disposed adjacent one of said axially spaced ends;

at least one vane mounted in said body for radial movement toward and away from said roller and being yieldably biased against said roller, said vane cooperating with said surface and said roller to form in said space a pocket whose volume alternately expands and contracts during rotation of said body, said pocket communicating with said gas inlet opening during said volume expansion to draw-in gas for pressurization during an initial phase of said volume contraction, and communicating with said gas discharge opening during a subsequent phase of said volume contraction to discharge the pressurized gas; and drive means for rotating said body about said first axis for bringing said pocket successively into communication with said gas inlet opening and said gas discharge opening;

wherein said gas discharge opening is positioned radially outside of said surface as said chamber is viewed in a direction parallel to said axes, said body including a gas discharge hole arranged adjacent respective ones of said vanes for communicating said pocket with said gas outlet opening.

2. The rotary compressor according to claim 1, wherein said gas discharge hole is formed in said surface.

3. The rotary compressor according to claim 1, wherein at least a portion of said gas inlet opening is arranged radially inside of said surface as said chamber is viewed in a direction parallel to said axes.

4. The rotary compressor according to claim 3, wherein each of said gas discharge and inlet openings has an arc-shape.

5. The rotary compressor according to claim 4, wherein the arc-shape of said gas discharge opening is coaxial with said first axis, and the arc-shape of said gas inlet opening is coaxial with said second axis.

6. The rotary compressor according to claim 1, wherein said gas discharge opening and gas inlet opening are disposed adjacent the same one of said axially spaced ends.

7. The rotary compressor according to claim 1, wherein one of said axially spaced ends comprises a plate, said gas inlet and discharge openings being formed in said plate, a shaft fixed to said plate and extending into said chamber, said roller being rotatably mounted on said shaft.

8. The rotary compressor according to claim 1, wherein said at least one vane comprises a plurality of vanes spaced circumferentially apart.

9. The rotary compressor according to claim 1, wherein said roller continually contacts said surface.

10. The rotary compressor according to claim 1, wherein there are two said vanes oriented diametrically opposite one another, and further comprising a C-shaped snap ring having first and second ends connected to respective vanes for biasing the vanes radially inwardly.

11. A rotary compressor, comprising:

a rotary body having a cylindrical surface and axially spaced ends forming a cylindrical chamber, said body being rotatable about a stationary first axis coinciding with a longitudinal axis of said chamber;

a cylindrical roller mounted in said chamber and rotatable about a stationary second axis arranged parallel and eccentrically relative to said first axis, an outer diameter of said roller being smaller than a diameter of said surface so that a space is formed between said roller and said surface;

a stationary gas discharge outlet disposed adjacent one of said axially spaced ends;

a stationary gas inlet opening disposed adjacent one of said axially spaced ends;

at least one vane mounted in said body for radial movement toward and away from said roller and being yieldably biased against said roller, said vane cooperating with said surface and said roller to form in said space a pocket whose volume alternately expands and contracts during rotation of said body, said pocket communicating with said gas inlet opening during said volume expansion to draw-in gas for pressurization during an initial phase of said volume contraction, and communicating with said gas discharge opening during a subsequent phase of said volume contraction to discharge the pressurized gas; and drive means for rotating said body about said first axis for bringing said pocket successively into communication with said gas inlet opening and said gas discharge opening;

wherein each of said gas discharge and inlet openings has an arc-shape, the arc-shape of said gas discharge opening being coaxial with said first axis, and the arc-shape of said gas inlet opening being coaxial with said second axis.

12. A rotary compressor, comprising:

a rotary body having a cylindrical surface and axially spaced ends forming a cylindrical chamber, said body being rotatable about a stationary first axis coinciding with a longitudinal axis of said chamber;

a cylindrical roller mounted in said chamber and rotatable about a stationary second axis arranged parallel and eccentrically relative to said first axis, an outer diameter of said roller being smaller than a diameter of said surface so that a space is formed between said roller and said surface;

a stationary gas discharge outlet disposed adjacent one of said axially spaced ends;

a stationary gas inlet opening disposed adjacent one of said axially spaced ends;

two vanes mounted in said body in diametrically opposed relationship for radial movement toward and away from said roller and being yieldably biased against said roller, said vanes cooperating with said surface and said roller to form in said space a pocket whose volume alternately expands and contracts during rotation of said body, said pocket communicating with said gas inlet opening during said volume expansion to draw-in gas for pressurization during an initial phase of said volume contraction, and communicating with said gas discharge opening during a subsequent phase of said volume contraction to discharge the pressurized gas;

drive means for rotating said body about said first axis for bringing said pocket successively into communication with said gas inlet opening and said gas discharge opening; and a C-shaped snap ring having first and second ends connected to respective vanes for biasing the vanes radially inwardly.

* * * * *